United States Patent [19]

Nava

[11] 4,247,960

[45] Feb. 3, 1981

[54] ACTUATING DEVICE FOR THE VIZORS OF HELMETS OR SIMILAR HEADGEARS

[76] Inventor: Pierluigi Nava, Verderio Superiore, Como, Italy

[21] Appl. No.: 973,719

[22] Filed: Dec. 27, 1978

[30] Foreign Application Priority Data

Feb. 13, 1978 [IT] Italy ..... 20250 A/78

[51] Int. Cl.[3] ..... A42B 3/02; A61F 9/00

[52] U.S. Cl. ..... 2/424; 2/10

[58] Field of Search ..... 2/424, 10, 9, 8, 6

[56] References Cited

FOREIGN PATENT DOCUMENTS

| | | | |
|---|---|---|---|
| 1034701 | 7/1978 | Canada | 2/424 |
| 2326156 | 4/1977 | France | 2/424 |
| 2338005 | 8/1977 | France | 2/10 |
| 7611248 | 4/1977 | Netherlands | 2/424 |
| 2004178 | 3/1979 | United Kingdom | 2/424 |

*Primary Examiner*—Peter P. Nerbun

*Attorney, Agent, or Firm*—Stevens, Davis, Miller & Mosher

[57] ABSTRACT

A vizor is retained to a helmet A by means of hinging members 22, 24, one member being associated with sliding organs 10, 12 connected with actuating means 26 and 28 by means of which the pivots 20 of the hinges are displaced with respect to the helmet, for the purpose of disengaging the rim of the vizor from a housing A1 located in the opening of the helmet.

19 Claims, 9 Drawing Figures

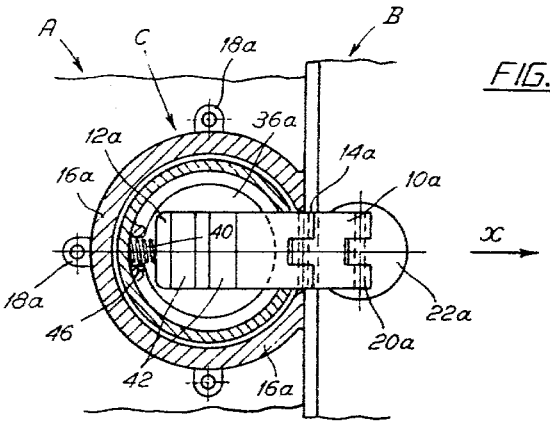
FIG. 5
FIG. 6
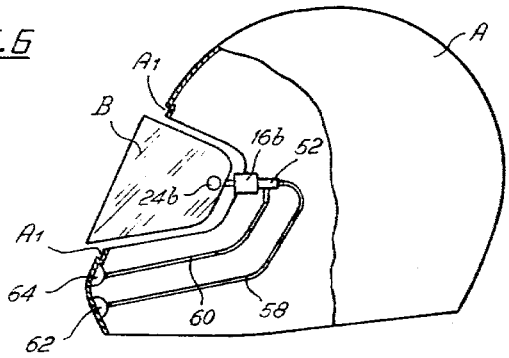
FIG. 7
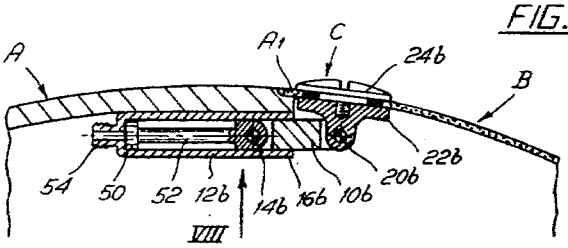
FIG. 8
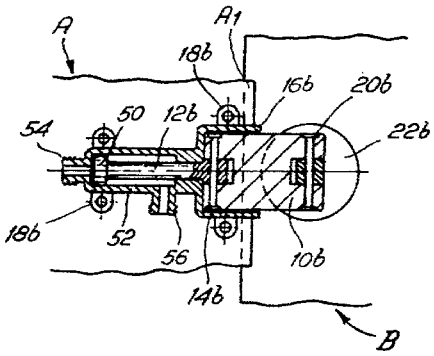
FIG. 9
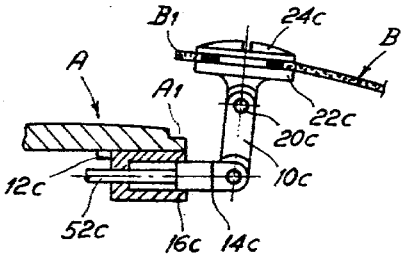

ACTUATING DEVICE FOR THE VIZORS OF HELMETS OR SIMILAR HEADGEARS

This invention relates to a device to actuate the vizors in helmets or similar headgear, used in particular in sports or by motorcyclists.

The front opening or window in sports helmets is usually provided with a vizor which may be moved away and oriented with respect to the opening as required by the wearer in order to create a more or less intense air circulation inside the helmet itself.

The shifting of the vizor with respect to the front opening or window usually requires the wearer to use both hands to adjust it in the desired position the vizor itself being secured to the helmet body by friction hinges or other suitable means.

The above operation is practically impossible on helmets in which the lowered vizor rests in a perimetral groove around the edge of the helmet's opening, as in such cases there are no projecting parts on the helmet's external surface. Hence, in this case the wearer is compelled to use both hands to adjust the position of the vizor which in addition to being a serious drawback, may also be a source of serious accidents due to the impossibility of the wearer to use his hands to drive the vehicle.

This invention proposes to obviate the above drawbacks and limitations, by providing a practical, quick and effortless means to adjust the vizor with one hand only or no hands, at all, thus ensuring continuous control of the vehicle by the driver.

In particular, the invention proposes a means for achieving the above purposes and suitable for application also to helmets of the usual type, without thereby limiting the helmet's use or causing any inconvenience to its wearer.

Another object of the invention is to provide a device apt to permit adjustment of the vizor (especially vizors with recessed edges) so that they may be first moved away from the peripheral ledge in the helmet and subsequently brought to the desired position. A still further object is to provide a vizor adjusting device of the specified type, but which also incorporates a hinge between itself and the helmet body in order to render it conveniently applicable to other types of helmets.

The device according to the invention is characterized by slider means associated with a control means and to a guiding device in the helmet body, the slider means being secured to the ends of the vizor to impart a rectilinear movement to the latter and permit its successive overturning.

The above arrangement is however subject to different embodiments without departing from the spirit and scope of the invention; for example, the control means may be actuated either by hand or by a fluid under pressure. The pressure may be generated in any known way, not excluding physiological pressure produced by the wearer by blowing into a cylinder/piston assembly.

In a preferred embodiment of the elementary device i.e. one of the two hinged elements securing the vizor to the helmet body, said elementary device is provided with a slider running in a guideway having hinges for the vizor at one of its ends while on the other end the slider is connected to control means secured to the slider guide, which is in turn provided with means for securing it to the internal wall of the helmet.

Obviously, the control means for the slider comprises a toothed section with related pinion, held by a suitable support and secured to the slider guide element, while the actuating pushbutton (accessible through a recess in the helmet wall) is secured to said pinion.

In one form of embodiment of the device, loading spring means are interposed between the slider and relevant guiding element; said spring means act on the slider so as to move the vizor away from the helmet opening, while a spring loaded rack in the slider and related guide element acts to hold the slider in the retracted position in opposition to the action of the loading spring means, while the moving part of the spring loaded ratchet gear has manual control means to disengage the elements of said ratchet gear, so that the spring means move the vizor away from the opening in the helmet.

In a further embodiment the slider is operably secured to the moving part of a cylinder/piston assembly, at least one chamber of said assembly being connected by suitable means to suitable shut off devices, to a pressurized fluid source, for example, compressed air, to actuate the vizor.

Obviously air under pressure generated by the wearer himself may be used as the actuating medium for the vizor. In this case, one or more of the chambers of the piston/cylinder assembly are connected by tubing to at least one mouth piece situated in a convenient position on the helmet and easily accessible to the mouth of the wearer who, by blowing into it, can actuate the cylinder/piston assembly to move the vizor.

The invention will now be described in conjunction with the attached drawings, which show, by way of example, some preferred forms of embodiment of the device as applied (but not exclusively) to motorcyclists helmets.

FIGS. 4 and 5 are representations similar to FIGS. 2 and 3 but show another embodiment.

FIG. 6 is similar to FIG. 1 and shows partially, in cross section a motorcyclist's helmet in which the vizor is actuated by a fluid under pressure.

FIGS. 7 and 8 are similar to FIGS. 2 and 3 but show the details of the device as FIG. 6.

FIG. 9 is similar to FIG. 7 but shows another version of FIG. 7 showing the vizor in lifted position.

Figure 1:
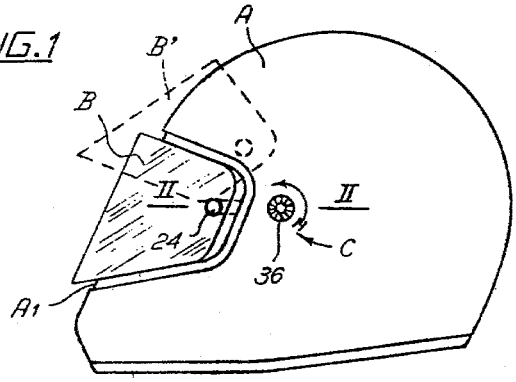
FIG. 1 is a side view of a helmet for motorcyclists fitted with the device according to the invention and in which the vizor is shown in a detached position with respect to the perimetrical ledge in the helmet opening.

In the drawings, equal parts are identified with equal symbols. Specifically, in the drawings letter A identifies the helmet, letter B the vizor and letter C the device according to the invention. The device consists of two equal elements secured as will be described above to the opposite ends B 1 of the helmet; as the two elementary devices on the helmet are identical, only one will be described.

In all the cases illustrated the edge of vizor B is apt fit in an annular ledge A 1 around the opening of helmet A so that the external surfaces of the vizor and helmet are perfectly flush to each other when closed.

Figure 2:
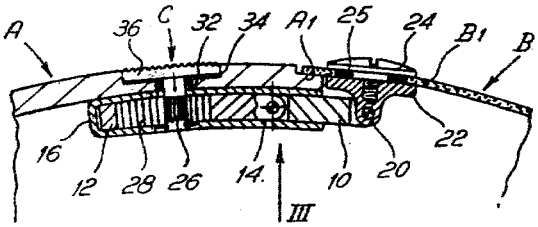
FIG. 2 is a cross sectional view, on a larger scale taken along lines II—II of FIG. 1.
Figure 3:
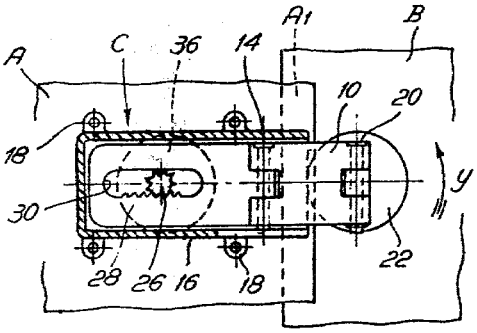
FIG. 3 is a view according to arrow III of FIG. 2 with some of the parts removed.

With reference to the elementary device shown in FIGS. 1 through 3 the device is provided with a slider which, in the case illustrated, is formed by elements 10 and 12 connected to each other by an articulated joint 14 with vertical oscillating axis. Slider 10–12 is slidably held in a guiding element formed by a sheath or housing 16 provided with perforated lugs 18 in a suitable position suitable to secure it to the internal wall of helmet A.

In the case under consideration the slider/guide element assembly is flattened in shape its cross section being that of a rectangle, the major sides of which run substantially parallel to the wall of helmet A.

The external element of slider 10–12 terminates in a first hinge 20 the axis of which is parallel to that of articulated point 14 and the terminal element of which consists of a round platelet 22 which holds in place the perforated end B1 of vizor B.

The annular gasket 25 interposed between these parts develops a braking action on the walls of the hole of said end B 1, to secure and maintain vizor B in the desired position after it has been moved away from the opening in the helmet.

The other element 12 of slider 10–12 is associated with control devices which in the case of FIGS. 1 through 3 consist of a pinion 26 which engages a ratchet gear 28 extending lengthwise along one of the sides of a slot 30 in said element 12. Pinion 26 is secured via a suitable support 32 to the wall of helmet A which terminates at the bottom of the circular ledge 34 on the outside surface of helmet A. Said ledge houses an actuating button 36 designed so as to project the least possible from the external surface of helmet A. The surface of said button 36 is knurled in order to facilitate its engagement with the users fingers to rotate it for shifting slider 10–12 and to disengage the edge of vizor B from annular ledge A 1 in the helmet. After this operation the wearer can shift the vizor to the desired position. In the case of motorcyclists' helmets, this movement can be performed by the wearer by inclining the head with the helmet, to set the vizor in order to be stuck by the wind and deviate the air flow from top to bottom and thus lift the vizor to the desired height.

Figure 4:
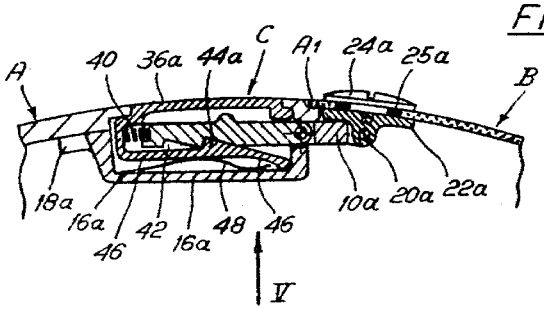

The device shown in FIGS. 4–5 is similar to that just considered and makes actuation of the vizor still simpler. In this version, parts corresponding to FIGS. 1 to 3 are identified by the same symbols followed by a letter (a). Slider **10*a*–12*a* is urged by spring means 40 formed by one or more coiled springs as well as flat springs. Said spring means are interposed between slider 10*a*–12*a* and housing 16*a* which slidably houses said slider 10*a*–12*a*; the action of these springs urges the slider in the direction of arrow x to move the edge of the vizor away from annular ledge A 1** in the helmet.

In this form of embodiment, slider **10*a*–12*a* is associated with locking devices which hold it in a retracted position, in opposition to the force exerted on it (slider) by spring means 40. One of the faces of element 12*a* in said slider is provided with two sawtooth shaped notches in which alternatively engage pawl 44 of a flat spring 46 urged in its turn by another flat spring 48, fitted in a suitable housing in sheath 16*a*. Flat spring 46 is secured firmly to button 36*a* fitted in a guideway 34*a* in the wall of helmet A in this embodiment, when the vizor is in the retracted position, as shown in FIGS. 4 and 5, the pawl 44 engages right hand notch 42 to hold slider 10*a*–12*a* in the retracted position in opposition to the action of spring 40. By depressing pushbutton 36*a*, pawl 44 is disengaged from its relevant notch 42 and the action of spring 40 will shift slider 10*a*–12*a* in the direction of arrow x, thus disengaging vizor B from the opening in helmet A. Resetting of visor A in ledge A of the helmet can be easily performed by the wearer by exerting a slight pressure on the visor in opposition to the action of spring 40, to re-engage pawl 44 with right hand notch 42**.

The embodiment shown in FIGS. 6 through 8 is identical to that of the previously considered figures, the corresponding parts being identified by the same reference numbers followed by letter (b). Slider/sheath assembly **10*b* –12*b*–16*b*** is associated in this case with a cylinder/piston assembly apt to permit adjustment of vizor (B) by means of a fluid under pressure.

In this embodiment, element **12*b* of the slider consists of the stem of a piston 50 operating in a cylinder 52 which terminates with a sheath 16*b* which is the guiding means for said slider. Cylinder 52 is secured by means of perforated lugs 18*b* to the inner wall of helmet (A) and is provided, toward its ends, with fittings 54 and 56 for permitting connection of suitable tubes 58 and 60 (see FIG. 6). Tubes 54 and 56 are connected via shut off means 62 and 64 fitted in the lower front part of helmet A, that is, in a position easily accessible to the wearer. Said shut off means 62 and 64 can may be connected to compressed air tanks and to relevant shut off devices which may be conveniently operated by the wearer to deliver air under pressure into the desired chamber of cylinder/piston assembly 50–52 to move the vizor toward or away from the annular ledge A 1** in the helmet opening.

Otherwise shut off means 62–64 may be in the form of bellows on which the wearer may act, for example, with his chin, to convey air pulses into either one of the chambers of cylinder/piston assembly 50–52 said shut-off elements 62–64 may consist of two mouth pieces fitted in suitable positions inside the helmet so that the wearer may grasp them with his mouth and blow air into either one to shift piston 50 in one direction or the other to move vizor B.

Obviously, in all the cases considered only one pneumatic chamber may also be contemplated, with a spring exerting a force on piston 50 in opposition to the pneumatic pressure. In this case the device is completed by a lock device similar to that shown in FIGS. 4 and 5. A further embodiment of the device is illustrated in FIG. 9, in which vizor B is connected, by articulated joints **14*c* and 20*c*, and stem 52*c* operating in a tubular guide 16*c*. In this embodiment stem 52*c* is linked to a control element (not shown) by at least partly flexible remote control means, consisting, for example of Teleflex, Boyden or similar cables, said means being apt to consent adjustment of vizor B in the desired position, as it can be seen on the drawing. Also in this embodiment, spring means may be provided to set vizor B in a desired final position, for example, in the closed position. The spring means may be secured to stem 52*c***.

In all the embodiments contemplated, vizor B may (in addition to the lifted position B' shown in FIG. 1), be adjusted in other positions comprised between closed position (FIGS. 2 and 8) and that of maximum opening in lowered position shown in FIG. 9. In these open positions, the edges $A_1$ of helmet A and $B_1$ of vizor B are substantially flush and aligned to form annular openings apt to consent air circulation within the helmet, as the device permits adjustable shifting of the vizor in the rectilinear direction. The achievement of the rational and practical objectives contemplated by the invention are thus clearly confirmed. In the case of motorcyclists, these may adjust the vizor practically without abandoning the drive of the vehicle.

It is understood that the present protection also covers the helmet itself, which incorporates the device according to the invention where the actuating means for the vizor, for example push button 36 or (36*a*), or cylinder/piston assembly 50–52, may be provided only in one of the two elements forming the pair of the hinging devices of vizor B to helmet A. It is also understood that changes may be introduced in the device according to the invention depending on requirements. For example, hinge 22–24 for vizor B may be located between housing 16 and helmet A. Moreover, the movement of slider 10–12 may be utilized to impart to vizor B also an angular movement about the pins of hinges 22–24 with the provision of adequately shaped guiding means between the vizor and helmet.

It is obvious that modifications such as the above can be introduced without departing from the spirit and scope of the invention.

I claim:

1. A device for changing the relative position of a vizor of a helmet, said helmet having a front-facing oblong opening, the outer perimeter of said opening having a recessed edge for receiving the outside edge of said vizor whereby said helmet and vizor have surfaces which are flush when said vizor is in a first position, comprising:

a slider means connected by hinges to ends of said vizor, said slider means having a slider element which moves in a linear direction with respect to said helmet, said slider element being connected to said vizor for supporting said vizor in a first and a second position;

guide means connected to said helmet for fixing said slider means to said helmet, said guide means permitting said slider element to move in a linear direction for changing said vizor position; and control means for actuating said slider means to produce the linear movement of said slider element whereby the position of said vizor is changed from said first position to said second position away from said helmet.

2. A device according to claim 1 characterized in that said slider means comprises at least two elements linked to each other by articulated points to permit reciprocal retraction of the vizor ends during the rectilinear movement of the latter.

3. A device according to claim 1 or 2 comprising spring means acting on a slider element to hold the vizor in one of its positions.

4. A device according to claim 1, wherein a slider element is linked to the ends of the vizor by at least one hinge.

5. A device according to claim 2 characterized in that the axes of the points connecting said slider elements are set at least in part at right angles to the axes of hinges connecting the vizor.

6. A device according to claims 1 or 2 wherein a slider element is connected to the vizor by means of 2 hinges having axes perpendicular to each other, said hinges comprising a pin engaging with a hole provided in the relative end of the vizor.

7. A device according to claims 1 or 2 wherein the control means for said slider means is provided with an actuating push button adapted to operate said slider means through suitable transmission means.

8. A device according to claim 1 or 2 wherein the control means for the slider means comprises a ratchet gear with a related pinion secured to an actuating push button and held by the helmet adjacent to said hinge which secures said vizor to said slider element.

9. A device according to claim 7, wherein slider element is influenced by spring means and an associated spring loaded latch in said guide means and which also holds said slider element in two predetermined positions which may be selected by means of said actuating push button.

10. A device according to claim 9, wherein said slider element is provided with at least two notches to engage alternatively a spring loaded pawl operatably connected with said actuating push button housed in an opening situated in a lateral wall of the helmet.

11. A device according to claims 10, wherein said spring loaded pawl is sawtooth shaped and adapted to alternatively engage notches of a slider element to hold the latter in opposition to the force exerted on it by said spring means.

12. A device according to claim 7, wherein a partly flexible remote control means operatively connects said slider means with said control means.

13. A device according to claim 7, wherein a control means for the slider consist of at least one cylinder/piston assembly which may be operated by a fluid under pressure.

14. A device according to claim 13, wherein a moving element of cylinder/piston assembly forms one of the parts of said slider means while the fixed part of said cylinder/piston assembly forms, at least in part, guiding means for said slider element.

15. A device according to claims 13 or 14 wherein a shut off means for the fluid under pressure, is provided said means being located on said helmet.

16. A device according to claims 13 or 14, wherein the source of the fluid under pressure is at least in part provided in the helmet.

17. A device according to claim 16, comprising at least one flexible bellows pneumatically connected to the chamber of said piston/cylinder assembly to actuate the slider connected to the screen.

18. A device according to claims 13 or 14 further comprising at least one mouth piece, said mouthpiece being pneumatically connected to cylinder/piston assembly to enable a wearer to operate said assembly.

19. A device according to claims 13 or 14 further comprising:

means for alternately connecting a pressure source to one of two pressure chambers located within said piston cylinder assembly.

* * * * *